United States Patent [19]

Cady, Jr.

[11] 3,935,771

[45] Feb. 3, 1976

[54] PUNCH AND STRIPPING GUIDE ASSEMBLY

[75] Inventor: Percy L. Cady, Jr., Darien Center, N.Y.

[73] Assignee: Houdaille Industries, Inc., Buffalo, N.Y.

[22] Filed: Feb. 10, 1975

[21] Appl. No.: 548,823

[52] U.S. Cl. ..... 83/140; 83/698

[51] Int. Cl.[2] ..... B26D 7/26

[58] Field of Search ..... 83/698, 697, 140

[56] References Cited

UNITED STATES PATENTS

| | | | |
|---|---|---|---|
| 3,263,549 | 8/1966 | Jordan | 83/698 |
| 3,274,878 | 9/1966 | Vecchi | 83/698 |
| 3,812,895 | 5/1974 | Smith | 83/698 |

*Primary Examiner*—Donald R. Schran

*Attorney, Agent, or Firm*—Hill, Gross, Simpson, Van Santen, Steadman, Chiara & Simpson

[57] ABSTRACT

Tooling for use in a punching device, the tooling being a punch and stripping guide assembly, comprises a stripper sleeve guiding a punch having a threaded end encircled by a stripping spring which is preloaded by a threaded punch head secured thereto, the threaded end and the threaded head having hexagonal axial openings in which a locking rod of corresponding cross-section is disposed.

9 Claims, 3 Drawing Figures

PUNCH AND STRIPPING GUIDE ASSEMBLY

BACKGROUND OF THE INVENTION

1. Field of the Invention

This invention relates to punch-type of tooling for use in punching devices such as turret presses.

2. Prior Art

It is known to provide a punch and stripping guide assembly which includes a stripper sleeve guiding a punch having a threaded upper end encircled by a stripping spring that is preloaded by means of a threaded punch head received on such punch. Such threaded punch head is susceptible to rotation as a consequence of the vibrations and shocks that are incident to usage, and therefore set screws have been used to hold such punch heads in "locked" position at a selected amount of spring compression or length. However, the threaded set screws are just as susceptible to loosening, thus leaving the punch head free to turn and to change its adjustment.

In a press of the turret type, there is a certain amount of clearance between the top of a turret on which tooling is supported and the lower surface of the ram or ram plate with which a selected tool assembly registers. Further, it is not always possible to know exactly what that clearance will be because the retracted position of the ram in a high-speed press may vary because a clutch or brake on a drive shaft which provides one complete punching stroke per revolution is not always stopped with the ram at its most retracted point. For example, a design clearance between the ram and the tooling of one-sixteenth inch in practice typically becomes one thirty-second inch, plus or minus one thirty-second inch. Thus with approximately zero clearance any loosening of such punch head as a consequence of shock and vibration not only has altered the length of die penetration in the workpiece but has provided an overall length of tooling which the turret press could not cope with.

SUMMARY OF THE INVENTION

According to this invention, the threaded end of the punch body and the punch head are provided with noncircular openings, such as openings of hexagonal cross-section, into which a noncircular rod, such as a piece of hexagonal stock is inserted. Means are provided for withdrawing such rod and for holding the punch to enable adjustment of the head.

Accordingly, it is an object of the present invention to provide means for locking a punch head on a punch in a manner that cannot be loosened by vibration or shock.

Another object of the present invention is to provide tooling for use in a punching device or punch press which can be accurately set before installation without change of such setting being possible except by deliberate adjustment.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWING

AS SHOWN ON THE DRAWING

Figure 1:
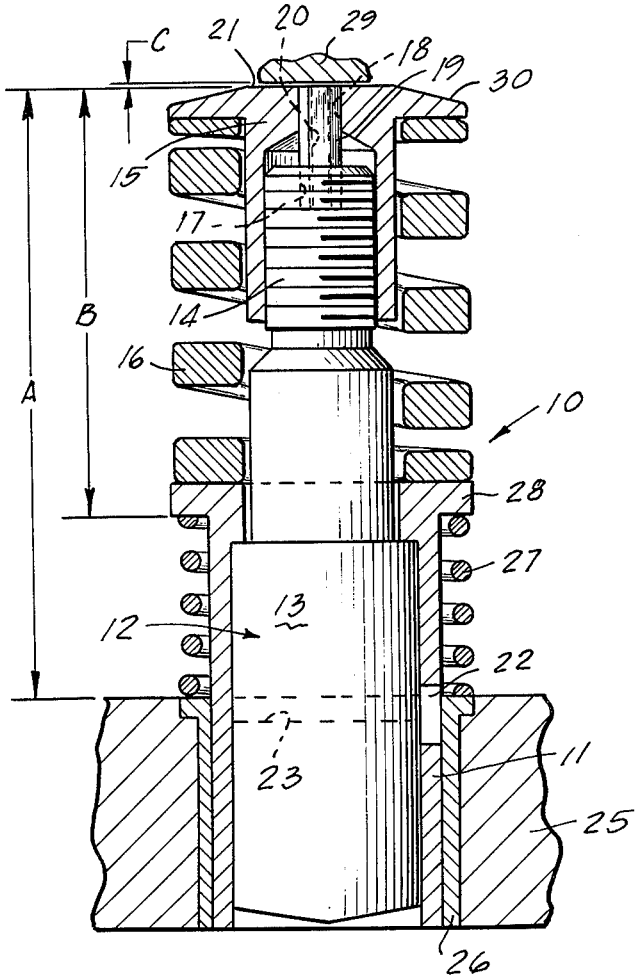
FIG. 1 is a cross sectional view of a punch and stripping guide assembly according to the present invention shown installed in a turret-type of punch press.
Figure 2:
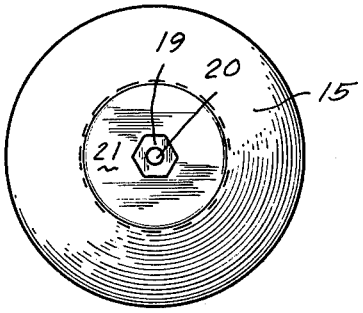
FIG. 2 is a top view of the punch and stripping guide assembly.

The principles of the present invention are particularly useful when embodied in a punch and stripping guide assembly such as shown in FIG. 1, generally indicated by the numeral 10 and also referred to herein collectively as "tooling". The tooling 10 includes a stripper sleeve 11 which also serves as a punch-guide, a punch 12 having a body 13 slidably disposed in the stripper sleeve 11 and having a threaded upper end portion 14, a punch head 15 threaded onto the upper end portion 14, there being a stripping spring 16 acting between the stripper sleeve 11 and the punch head 15.

According to the invention, the upper end portion 14 of the punch 12 has an axial opening 17 of noncircular cross-section, here shown has being hexagonal, and the head 15 has a noncircular axial opening 18, here shown to be hexagonal, in registration with the opening 17. A locking rod 19 of noncircular cross-section extends into both of the openings 17 and 18 and prevents any rotation of the head 15 with respect to the punch 12, such cross-section being hexagonal.

The rod 19 is preferably non-metallic and has an axial opening 20 for facilitating removal thereof, such as by insertion of a self-tapping screw, coupled with pulling on such screw. The rod 19 has a close but not a negative fit, but even so there is a tendency for such rod 19, under the type of use that this equipment is subjected to, to become jammed. By the use of non-metallic material, rotation can be avoided but the part can be broken or sheared off by intentional overpowering the same, and the use of materials such as plastic or urethane is therefore preferable as these can be removed without damage to the metal parts. The rod 19 is of such lengths with respect to the adjusted position of the head 15 and the lengths of the opening 17 that its upper end is flush or substantially flush with the top surface 21 of the head 15.

When the tooling 10 is out of the press, and it is desired to make the adjustment referred to, a hand implement may be inserted through an opening 22 in the sleeve 11 into a second opening 23 in the punch 12. During initial adjustment, a hexagonal wrench is inserted in the opening 18 to rotate the head 15 with respect to the punch 12.

Figure 3:
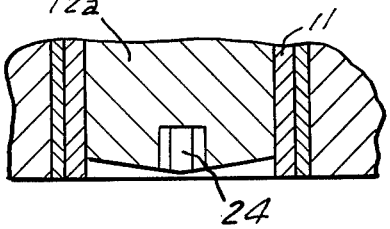
FIG. 3 is a cross sectional view of a modified form of the punch of FIG. 1.

An alternate to the transverse opening 23 is shown in FIG. 3 where a punch **12*a* has a lower end that is provided with a hexagonal opening 24** for receiving another hexagonal wrench for the purpose described.

The punch press shown here as environment includes an upper turret 25 having a bushing 26 on which a lifting spring 27 rests to act against a flange 28 on the stripper sleeve 11. The station of the turret 25 that includes the bushing 26 is shown as having been indexed or rotated to be in alignment with a fragmentarily illustrated punch ram or ram plate 29. The total available clearance between the upper surface of the turret 25 is indicated by the dimension A, thus providing a representative clearance C between the ram 29 and the upper surface 21 of the head 15. It is this clearance dimension which may go as low as zero. When the turret 25 is indexed to bring the tooling 10 into alignment with the ram 29, some safety is provided by virtue of a bevel 30 on the head 15 and a corresponding bevel on the ram 29. As a practical matter, the tooling 10 is not adjusted in the punch press, but at a remote location and the only practical dimension that the workman has to work with is that shown at B, or the overall length of the tooling 10. Using appropriate gaging and with hand tools inserted into the tooling 10 before the rod 19 is installed, the length is set precisely, within a thousandth of an inch, to the maximum length that can be safely accommodated by the press. Thereafter, the head 15 is further turned to shorten the overall length until the two hexagonal openings 17, 18 have complemental surfaces that are aligned. Where the cross-sectional configuration is a hexagon, such additional turning will not exceed 60° of rotation, and for a typical thread pitch, such shortening will therefore not exceed 0.01 inch. Thus the effective length of the tooling 10 is precisely adjustable to be but a fraction of what the maximum dimension C can be. With this structure, loss of adjustment cannot take place and thus die penetration is accurately controlled, and no problem is encountered with the turret press as to the envelope size of tooling that it can accommodate. The use of a self-tapping screw for removal of the plug 19 is preferable because then the plug can be reused.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. Tooling for use in a punching device, said tooling comprising:

a. a punch-guide and stripper sleeve;

b. a punch having a body slidably disposed in said sleeve and having a threaded upper end portion, said threaded end portion having an axial opening of non-circular cross-section;

c. a punch head threaded onto said end portion and having an axial opening therethrough of non-circular cross-section;

d. a stripping spring acting between said sleeve and said punch head to urge the lower end of said punch into said sleeve; and e. a locking rod of non-circular cross-section extending into both of said openings for preventing rotation of said punch head.

2. Tooling according to claim 1 in which said rod has the physical properties of one of urethane and plastic.

3. Tooling according to claim 1 in which said rod is nonmetallic.

4. Tooling according to claim 1 in which said rod has a snug fit in said openings.

5. Tooling according to claim 1 in which said rod has an axial opening for receiving rod-removal means.

6. Tooling according to claim 1 in which said axial opening and said rod have hexagonal cross-sections.

7. Tooling according to claim 1 including means on said punch receptive of a hand tool for adjusting the positon of said punch head on said punch.

8. Tooling according to claim 1 including an axial opening of non-circular cross-section disposed in the lower end of said punch.

9. Tooling according to claim 6 in which said lower end of said punch has an axial opening of hexagonal crosssection.

* * * * *